US011234496B2

(12) United States Patent
Camilli

(10) Patent No.: US 11,234,496 B2
(45) Date of Patent: Feb. 1, 2022

(54) FOLDING BUCKLE CLASP

(71) Applicant: BULGARI HORLOGERIE SA, Neuchâtel (CH)

(72) Inventor: Alessandro Camilli, Le Landeron (CH)

(73) Assignee: BULGARI HORLOGERIE SA, Neuchatel (CH)

( * ) Notice: Subject to any disclaimer, the term of this patent is extended or adjusted under 35 U.S.C. 154(b) by 0 days.

(21) Appl. No.: 16/493,399

(22) PCT Filed: Mar. 19, 2018

(86) PCT No.: PCT/EP2018/056832

§ 371 (c)(1),
(2) Date: Sep. 12, 2019

(87) PCT Pub. No.: WO2018/172253

PCT Pub. Date: Sep. 27, 2018

(65) Prior Publication Data

US 2020/0008543 A1 Jan. 9, 2020

(30) Foreign Application Priority Data

Mar. 23, 2017 (CH) ..... 00379/17

(51) Int. Cl.
*A44C 5/24* (2006.01)

(52) U.S. Cl.
CPC ..... *A44C 5/24* (2013.01)

(58) Field of Classification Search
CPC ..... A44C 5/24; A44C 5/243; Y10T 24/2155; Y10T 24/4782
See application file for complete search history.

(56) References Cited

U.S. PATENT DOCUMENTS 2,532,840 A * 12/1950 Gaun ..... A44C 5/24 24/71 R
5,579,559 A * 12/1996 Ferrario ..... A44C 5/24 24/71 J (Continued)

FOREIGN PATENT DOCUMENTS

EP 1 074 198 A1 2/2001
GB 405452 A 2/1934

OTHER PUBLICATIONS

International Search Report and Written Opinion dated May 18, 2018 issued in corresponding application No. PCT/EP2018/056832; w/ English partial translation and partial machine translation (19 pages).

*Primary Examiner* — Robert Sandy
*Assistant Examiner* — Rowland Do
(74) *Attorney, Agent, or Firm* — Westerman, Hattori, Daniels & Adrian, LLP

(57) ABSTRACT

The invention relates to a folding buckle clasp for a strap (2) of a timepiece (3), which can take up a closed position for keeping the strap (2) around the wearer's wrist and an open position for removing the strap (2) from the wearer's hand, the clasp (1) being provided with a flexible locking member (4) comprising ends (5) that are mounted in a pivotable manner with first and second folding leaves (6*a*, 6*b*) attached in a hinged manner to first and second strands (7*a*, 7*b*), respectively, of the strap (2), said flexible member (4) being defined to keep the first and second leaves (6*a*, 6*b*) folded in a locked manner in the closed position of the clasp (1) by having two components (8*a*, 8*b*) connected together by an elastic connection (9).

23 Claims, 2 Drawing Sheets

(56) References Cited

U.S. PATENT DOCUMENTS

| | | | | |
|---|---|---|---|---|
| 5,689,859 | A * | 11/1997 | Cuche | A44C 5/24<br>24/265 WS |
| 6,401,307 | B1 * | 6/2002 | Wild | A44C 5/246<br>24/71 J |
| 6,449,809 | B2 * | 9/2002 | Thalheim | A44C 5/24<br>24/71 J |
| 9,173,460 | B2 * | 11/2015 | Kaltenrieder | A44C 5/24 |
| D848,303 | S * | 5/2019 | Register | D11/3 |
| 2004/0163217 | A1 * | 8/2004 | Ferrario | A44C 5/24<br>24/71 J |
| 2005/0193767 | A1 * | 9/2005 | Frank | A44C 5/14<br>63/9 |
| 2007/0028586 | A1 * | 2/2007 | Grossiord | B21D 53/44<br>59/15 |
| 2015/0351503 | A1 * | 12/2015 | Isaacs | A44C 5/24<br>63/3 |

* cited by examiner

FOLDING BUCKLE CLASP

The present invention relates to a folding buckle clasp for a bracelet of a timepiece and to the bracelet having such a clasp.

The invention also relates to a timepiece having such a bracelet.

In the prior art, a folding buckle clasp for a bracelet of a timepiece is generally disposed between two strands of this bracelet so as to always remain secured to the ends of these two strands. Such a clasp takes up two positions: a closed position, provided for wearing the timepiece, in which the bracelet and the clasp extend around the circumference of the wrist, having a total length allowing the retention of the timepiece, and an open position, which makes it possible to increase the length of the bracelet and of the clasp, increasing the distance between the two ends of the two strands of the bracelet, without detaching them from the clasp, in order to allow the watch to pass over the hand and to be removed. In this open configuration of the clasp, the two strands of the bracelet are not disconnected, thereby minimizing the risk of the watch being dropped.

In this context, such a clasp conventionally comprises two blades that are mounted in a rotatable manner respectively at the two ends of a central blade and are foldable over this central blade, and a pushbutton device for unlocking the clasp in order to change the latter from the closed position to the open position.

However, one of the drawbacks of such a clasp lies in the significant size thereof that results from a complex assembly of the parts of which it is made, having in particular the pushbutton device and the associated mechanism. Such a size has the consequence of considerably impairing the comfort associated with wearing the timepiece. In addition, this size also has a significant and negative impact on the esthetic appearance of the clasp and thus of the timepiece.

The present invention aims to remedy these drawbacks associated with the prior art.

To this end, the invention relates to a folding buckle clasp for a bracelet of a timepiece, which can take up a closed position for keeping the bracelet around the wearer's wrist and an open position for removing the bracelet from the wearer's hand, the clasp being provided with a flexible locking member comprising ends that are mounted in a pivotable manner with first and second foldable blades attached in a hinged manner to first and second strands, respectively, of the bracelet, said flexible member being defined to keep the first and second blades folded in a locked manner in the closed position of the clasp by having two components connected together by an elastic link.

In further embodiments:

- the flexible locking member is an elastic blade comprising said two components;
- said two components each correspond to a blade;
- the elastic link comprises a linking arm defined in a body of each of the two components, in particular in one end of said body;
- the elastic link comprises a connecting element connecting the linking arms of the two components together;
- the linking arm is connected to a main part of the body of each component at one end and to a connecting element at another, opposite end of said arm;
- each component comprises a body, one end of which is provided with slots, in particular two slots, separating a part of a linking arm from a main part of this body;
- the clasp comprises an outer face comprising a substantially convex or convex external face of the flexible locking member and substantially concave or concave external faces of the first and second blades;
- the first and second blades are rigid blades;
- the first and second blades each comprise a frame comprising side members, in particular two side members;
- the side members are parallel to one another; and
- the frame comprises a space defined between the side members and intended to accommodate a body of the component mounted in a pivotable manner with the blade comprising said frame.

The invention also relates to a bracelet for a timepiece, having such a folding buckle clasp.

Advantageously, first and second strands of said bracelet each comprise, at their free end, a housing defined in an innerface of each of these strands.

Also advantageously, the housing is defined to receive one of the first and second blades comprising a body of a component mounted in a pivotable manner with said blade arranged in a space defined in a frame of this blade when the clasp is in a closed position.

In particular, the housings defined in the first and second strands are able to receive first and second blades and a flexible locking member in a closed position of the clasp such that the external faces of these first and second blades and an internal face of this flexible locking member and also inner faces of the free ends of the first and second strands are contained substantially in a single plane.

The invention also relates to a timepiece having such a bracelet.

Further advantages and features of the invention will become more clearly apparent from reading the following description of a preferred embodiment, with reference to the figures, which is given by way of indicative and nonlimiting example:

In the following description, identical reference numerals denote identical parts or parts having similar functions.

Figure 1:
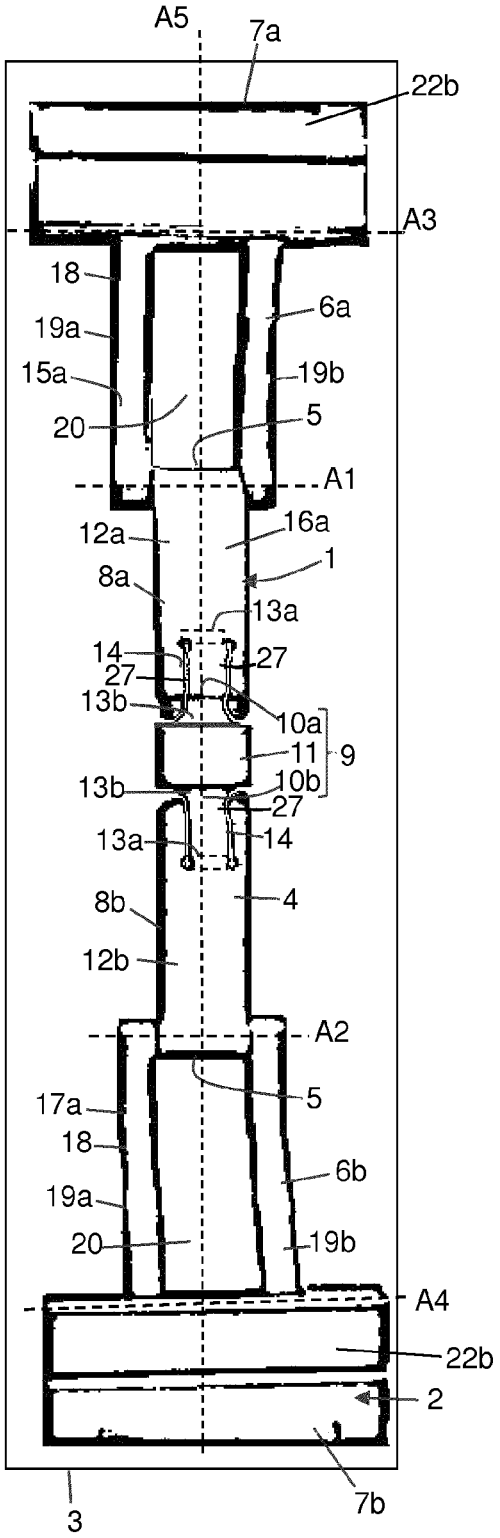
FIG. 1 shows a schematic view of a clasp for a bracelet of a timepiece, configured in an open position, according to the embodiment of the invention.
Figure 2:
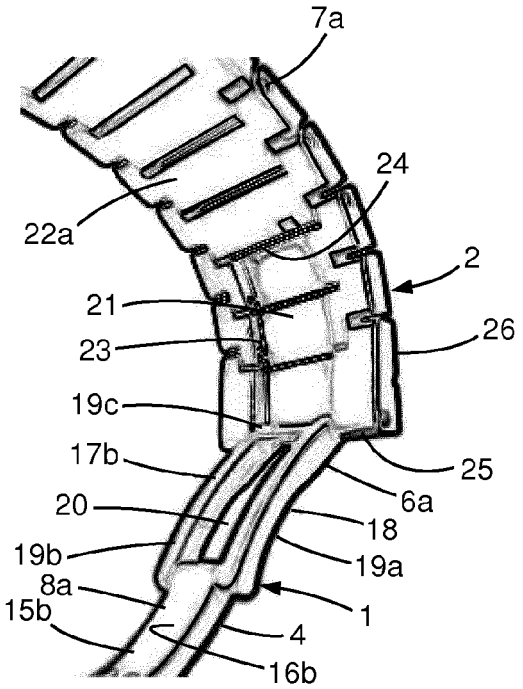
FIG. 2 is a perspective view of an inner face of a strand of the bracelet connected to the clasp, according to the embodiment of the invention.
Figure 3:
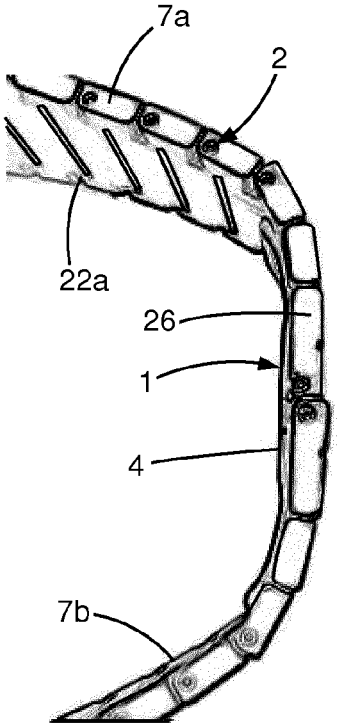
FIGS. 3 to 5 show different view of the bracelet comprising the clasp configured in a closed position, according to the embodiment of the invention.
Figure 4:
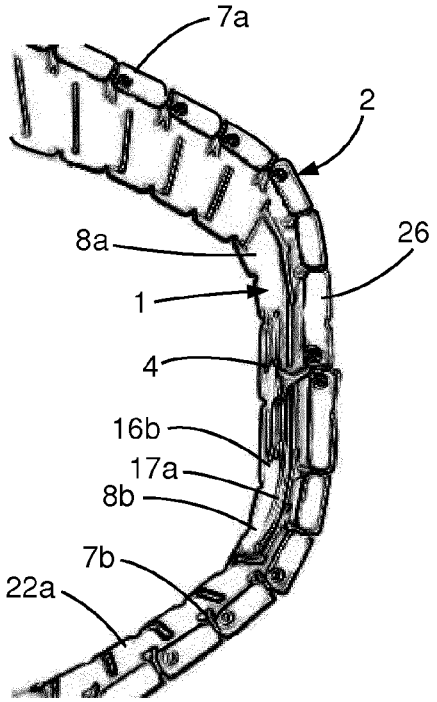
Figure 5:
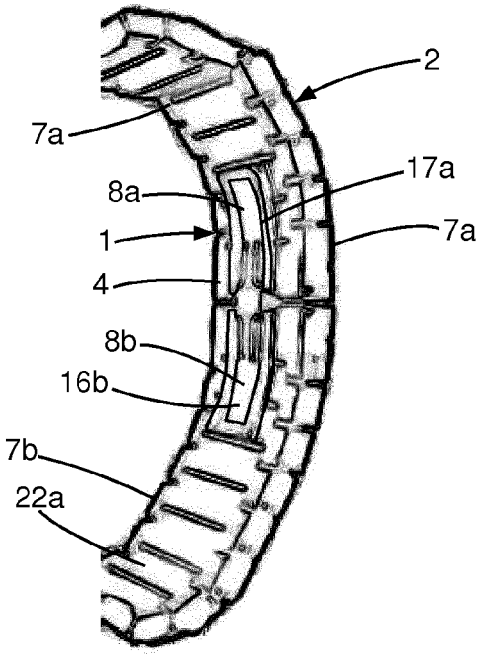

A particular embodiment of a folding buckle clasp will now be described in detail in a nonlimiting manner. As shown in FIGS. 1 to 5, the folding buckle clasp 1 can correspond to a "tri-fold buckle clasp" or to a "bi-fold buckle clasp", which is defined in particular to be joined to a timepiece 3. However, in one variant, this clasp 1 can be joined to any other bracelet 2, for any object to be fastened to a wrist or any other part. This object may be a scuba diving accessory such as a depth gage or a scuba diving computer for example, or a jewelry component. The bracelet 2 may be of any type, for example made of flexible plastic, of leather, or of an assembly of metal links.

Generally, the bracelet 2 of the timepiece 3 is made up of two longitudinal bracelet 2 portions, first and second bracelet 2 strands 7*a*, 7*b*, and each of the strands 7*a*, 7*b* is such that one of the ends is connected to a case of the timepiece 3 while the other end, which is free, is intended to cooperate with the clasp 1 in order for the bracelet 2 to be in a closed or open configuration.

The free end of each of the strands 7*a*, 7*b* comprises a housing 21 defined in an inner face 22*a* of each of these strands 7*a*, 7*b*. This housing 21 comprises a bottom and three walls bordering this bottom: two side walls 23 and a rear wall 24. It will be noted that the side walls 23 are preferably substantially parallel to one another and perpendicular to the rear wall 24. In this configuration, the housing 21 has an opening in a frontal edge 25 of the end of each of these strands 7*a*, 7*b*.

The first and second strands 7*a*, 7*b* also each comprise, at this free end, through-orifices that open out in the side walls 23 of the housing 21 and in the side walls 26 of each of these two strands 7*a*, 7*b*.

This clasp 1 is able to take up a closed position for keeping the bracelet 2 around the wearer's wrist and an open second position for removing the bracelet 2 from the wearer's hand.

Such a clasp 1 has three elements 4, 6*a*, 6*b*: first and second foldable blades 6*a*, 6*b* that are preferably rigid and a flexible locking member 4. These elements 4, 6*a*, 6*b* of the clasp are preferably made of a similar material, in particular a metal material. In addition, these elements 4, 6*a*, 6*b* may jointly form a one-piece unit, and under these conditions the clasp 1 can then be a one-piece or monolithic part.

In addition, this clasp 1 also has outer and inner faces 15*a*, 15*b*. The outer face 15*a*, which is visible in FIG. 1, comprises the external face 16*a* of the flexible member 4 and external faces 17*a* of the first and second blades 6*a*, 6*b*. Similarly, the inner face 15*b* comprises the internal face 16*b* of the flexible member 4 and internal faces 17*b* of the first and second blades 6*a*, 6*b*.

In this clasp 1, the flexible locking member 4 comprises ends 5 that are mounted in a pivotable manner with the first and second foldable blades 6*a*, 6*b* in the housings 21 defined in the inner faces 22*a* of the ends of the first and second strands 7*a*, 7*b*. In other words, these first and second blades 6*a*, 6*b* are mounted in a pivotable manner at the two ends 5 of the flexible member 4 about a first linking axis A1 and a second linking axis A2, respectively.

These first and second blades 6*a*, 6*b* each comprise a frame 18. This frame 18 has side members 19*a*, 19*b*, in particular two side members, and a base 19*c*. These side members 19*a*, 19*b* are substantially parallel to one another and perpendicular to the base 19*c*. Under these conditions, the frame 18 is substantially U-shaped. These side members 19*a*, 19*b* comprise first ends connecting the first and second blades 6*a*, 6*b* to the ends 5 of the flexible member 4, starting from the first and second linking axes A1, A2, respectively. In this frame 18, the base 19*c* is arranged in a manner connecting the two ends of the side members 19*a*, 19*b* together. This base 19*c* comprises a through-opening that opens out in external side faces of the side members 19*a*, 19*b* and thus of the frame 18.

In this configuration, for each of these strands 7*a*, 7*b*, this through-opening and the corresponding through-orifices are defined to be passed through by a fixing bar or by a fixing rod so as to produce:

- a first hinged attachment axis A3 between the free end of the first strand 7*a* and the first blade 6*a*, and
- a second hinged attachment axis A4 between the free end of the second strand 7*b* and the second blade 6*b*.

In this clasp 1, and in particular in the frames 18 of the first and second blades 6*a*, 6*b*, the first and second linking axes A1, A2 are opposite the first and second attachment axes A3, A4, respectively. It will be noted that these first and second linking axes A1, A2 and these first and second attachment axes A3, A4 can be realized as any appropriate hinging means for hinging the first and second blades 6*a*, 6*b* with:

- the flexible member 4, and
- the free ends of the first and second strands 7*a*, 7*b* of the bracelet 2.

The frame 18 of each of these first and second blades 6*a*, 6*b* comprises a space 20 defined between the side members 19*a*, 19*b*. In particular, this space 20 is defined in the frame 18 of the first blade 6*a*, between these side members 19*a*, 19*b*, the first linking axis A1 and the first attachment axis A3. In the frame 18 of the second blade 6*b*, this space 20 is defined between the side members 19*a*, 19*b*, the second linking axis A2 and the second attachment axis A4. In these two blades 6*a*, 6*b*, these spaces 20 are provided to accommodate the flexible member 4 of the clasp 1. In other words, this space 20 can correspond to an opening defined in each first and second blade 6*a*, 6*b* connecting the external and internal faces 17*a*, 17*b* of each of these blades 6*a*, 6*b* and thus of their frame 18. It will be noted that the external face 17*a* of each first and second blade 6*a*, 6*b* is preferably substantially concave or concave.

In addition, such a space 20 defined in the frame 18 of one of the two blades 6*a*, 6*b* is provided to accommodate in particular a body of one of the components 8*a*, 8*b* of the flexible member 4, described below, that is mounted in a pivotable manner with said frame 18 of the blade 6*a*, 6*b*. In this context, this space 20 has a shape that is complementary to that of the body of one of the components 8*a*, 8*b* of the flexible member 4. Moreover, it will be noted that this body has a thickness that is less than or equal to a thickness of the frame 18 of each of the first and second blades 6*a*, 6*b*.

This flexible member 4 is in particular defined to keep the first and second blades 6*a*, 6*b* folded in the housings 21 defined in the inner faces 22*a* of the strands 7*a*, 7*b* of the bracelet 2, in a locked manner in the closed position of the clasp 1. This flexible member 4 has the two components 8*a*, 8*b* connected together by an elastic link 9. The flexible member 4 and in particular this elastic link 9 helps to ensure the kinematics of the clasp 1, and more specifically helps to realize the locking and unlocking thereof and/or the configuration thereof in a closed or open position.

In this flexible member 4, these two components 8*a*, 8*b* each preferably correspond to a blade. In one variant, the flexible member 4 is an elastic blade or a flexible blade. In other words, in such a variant, these two components 8*a*, 8*b* form this single elastic blade. This flexible member 4 likewise comprises the external and internal faces 16*a*, 16*b*. The external face 16*a* is preferably substantially convex or convex. In another variant, this flexible member 4 is an elastic linking element other than a blade, in particular in terms of structure and/or shape, which is able to connect the first and second blades 6*a*, 6*b* together. In this latter variant, the clasp 1 then comprises two blades 6*a*, 6*b*, the first and second blades 6*a*, 6*b*, and the flexible member 4. It will thus be understood that, in this embodiment of the invention, the clasp 1 comprises at least two blades.

Such a flexible member 4 thus comprises these two components 8*a*, 8*b* and a connecting element 11 involved in the elastic link 9 between these two components 8*a*, 8*b*. This connecting element 11 is arranged in a central part of this member 4.

This elastic link 9 between the two components 8*a*, 8*b* thus comprises the connecting element 11 and linking arms 10*a*, 10*b* defined in the body of each of the components 8*a*, 8*b*, in particular in one end of this body. Specifically, the body of each component 8*a*, 8*b* comprises a main part 12*a*, 12*b* and the linking arm 10*a*, 10*b*. This linking arm 10*a*, 10*b* comprises side walls 27, which are separated from the main part 12*a*, 12*b* of the body of each component 8*a*, 8*b* by slots 14 made in this body. In other words, the end of the body of each component 8*a*, 8*b* is provided with these slots 14, in particular with two slots 14, which are intended to separate a part of the linking arm 10*a*, 10*b* from the main part 12*a*, 12*b* of this body. In this flexible member 4, each linking arm 10*a*, 10*b* is connected to the main part 12*a*, 12*b* of the body of each component 8*a*, 8*b* at one end 13*a* and to the connecting element 11 at another, opposite end 13*b* of said arm 10*a*, 10*b*.

Therefore, in this configuration, such a link 9 helps to give the flexible member 4 elastic characteristics. Specifically, the linking arms 10*a*, 10*b* and the connecting element 11 can be moved in a direction substantially perpendicular or perpendicular to the external and internal faces 16*a*, 16*b* of the flexible member 4, in particular relative to the main parts 12*a*, 12*b* of the body of the components 8*a*, 8*b*, during the locking or unlocking of the clasp 1.

The locking of the clasp 1 according to the invention will now be described in detail with reference to FIGS. 1 to 5. Starting from the open and thus unfolded position of the clasp 1 illustrated in FIGS. 1 and 2, the flexible member 4 is manipulated so as to cause the first and second foldable blades 6*a*, 6*b* to pivot about the first and second axes A1, A2 in the direction of the side members 21 defined in the free ends of the strands 7*a*, 7*b* of the bracelet 2. During this operation, the bodies of the components 8*a*, 8*b* of the flexible member 4 are positioned progressively, while the first and second blades 6*a*, 6*b* move toward the housings 21, in the spaces 20 defined in the frames 18 of these blades 6*a*, 6*b*.

During this operation, the flexible member 4 is progressively stretched under the tensile force until it passes a critical point, forming a point of unstable equilibrium, beyond which the flexible member 4 tends to relax. Specifically, when this critical point is reached, the tension in the flexible member 4 is at a maximum and once this critical point has been passed, the flexible member 4 tries to relax and thus drives the connecting element 11 into a housing which is defined between the first and second blades 6*a*, 6*b*, and in particular between the bases 19*c* of the frames 18 of these first and second blades 6*a*, 6*b*. The clasp 1 is then in the closed position visible in FIGS. 3 to 5. In this closed position, the bodies of the components 8*a*, 8*b* of the flexible member 4 are arranged in the spaces 20 in the first and second blades 6*a*, 6*b* and the latter are folded up in the housings 21, specifically such that the external faces 17*a* of these blades 6*a*, 6*b* and the internal face 16*b* of the body of the components 8*a*, 8*b* of the flexible member 4 and the inner faces 22*a* of the free ends of the first and second strands 7*a*, 7*b* are contained substantially in a single plane.

In this closed position, the holding of the first and second blades 6*a*, 6*b* by the flexible member 4 in the housings 21 and of the connecting element 11 in the housing defined between these first and second blades 6*a*, 6*b* is ensured by the tension of this flexible member 4. The flexible member 4 maintains a biasing tension that cancels out any residual play. In this closed position, a pulling force exerted on the first and second blades 6*a*, 6*b* via the first and second strands 7*a*, 7*b* of the bracelet 2 to which they are connected and directed substantially parallel to their respective longitudinal axis A5 has the effect not only of not tending to open the clasp 1 but, on the contrary, of increasing the locking force thereof.

The unlocking of the clasp will now be described in detail. From the closed position illustrated in FIGS. 3 to 5, the wearer exerts a force on the first and/or second blades 6*a*, 6*b* via the first and/or second strand 7*a*, 7*b* (in particular the end of the first and/or second strand 7*a*, 7*b*), directed substantially perpendicularly to an outer face 22*b* of the ends of these strands 7*a*, 7*b*, in order to move the first and/or second blades 6*a*, 6*b* relative to the flexible member 4. This operation has to be continued until the critical point at which the tension in the flexible member 4 is at a maximum is passed. Once this critical point has been passed, the flexible member 4 relaxes, causing it and also the first and second blades 6*a*, 6*b* to unfold. The clasp 1 is thus in its open position illustrated in FIG. 1, in which the flexible member 4 is in an unstressed state and is entirely free to pivot about the first and second linking axis A1, A2, as are the first and second blades 6*a*, 6*b* with this flexible member 4 and also with the first and second strands 7*a*, 7*b* about the first and second attachment axes A3, A4.

It will be understood that the force necessary to lock and unlock the clasp 1 according to the invention depends in particular on the elastic properties of the flexible member 4 and in particular on the characteristics of the elastic link 9 realized between the components 8*a*, 8*b* of this member 4. The configuration of this elastic link 9 can be realized such that the pulling force necessary for unlocking the clasp 1 is high, making the clasp 1 even more secure.

The clasp 1 according to the invention affords numerous advantages, including that of incorporating such a clasp 1 in a thickness of the ends of the first and second strands 7*a*, 7*b* of the bracelet 2 by arranging the flexible member 4 and the first and second blades 6*a*, 6*b* in housings 21 defined in these strands 7*a*, 7*b* when the clasp 1 is in the closed position. Thus, in this closed position, the clasp 1 is not visible from the outside and therefore does not mar the overall appearance of the bracelet 2 and/or of the timepiece 3, thus making it possible to personalize this bracelet 2 and/or the timepiece 3 without impairing the operation of the clasp 1. In addition, in this context, this clasp 1 makes it possible to improve the comfort associated with wearing the timepiece 3 compared with the discomfort brought about by the overthickness that arises in prior art folding buckle clasps.

In addition, it will be noted that the arrangement of the first and second blades 6*a*, 6*b* in series with the flexible member 4 and the few parts making up this clasp 1 give the latter an optimal size since it is compact and in proportion in the closed position and allows sufficient unfolding in the open position.

The invention claimed is:

1. A folding buckle clasp for a bracelet of a timepiece, which can take up a closed position for keeping the bracelet around the wearer's wrist and an open position for removing the bracelet from the wearer's hand, the clasp comprising:

a flexible locking member, and first and second blades, wherein ends of the flexible locking member are mounted in a pivotable manner at respective pivot axes with the first and second foldable blades and the first and second foldable blades are attached in a hinged manner to first and second strands, respectively, of the bracelet, and wherein the flexible locking member comprises two components connected together by an elastic link that applies an elastic force in a direction substantially perpendicular to said pivot axes such as to keep the first and second blades folded in a locked manner in the closed position of the clasp.

2. The clasp as claimed in claim 1, wherein the flexible locking member is an elastic blade comprising the two components.

3. The clasp as claimed in claim 1, wherein the two components each correspond to a blade.

4. The clasp as claimed in claim 1, wherein the elastic link comprises a respective linking arm defined in a body of each of the two components.

5. The clasp as claimed in claim 4, wherein the elastic link comprises a connecting element connecting the linking arms of the two components together.

6. The clasp as claimed in claim 5, wherein the linking arm is connected to a main part of the body of each component at one end of the linking arm, and to the connecting element at another, opposite end of the linking arm.

7. The clasp as claimed in claim 4, wherein the linking arm is defined in one end of the body of each of the two components.

8. The clasp as claimed in claim 1, wherein each of the components comprises a respective body, one end of which is provided with slots separating a part of a linking arm from a main part of the respective body.

9. The clasp as claimed in claim 8, wherein the end of the respective body of each of the components comprises two slots.

10. The clasp as claimed in claim 1, which comprises an outer face comprising a substantially convex or convex external face of the flexible locking member and substantially concave or concave external faces of the first and second blades.

11. The clasp as claimed in claim 1, wherein the first and second blades are rigid blades.

12. The clasp as claimed in claim 1, wherein the first and second blades each comprise a respective frame comprising side members.

13. The clasp as claimed in claim 12, wherein the side members are parallel to one another.

14. The clasp as claimed in claim 12, wherein the frame comprises a space defined between the side members and adapted to accommodate a body of the flexible locking member mounted in a pivotable manner with the blades comprising the frame.

15. The clasp as claimed in claim 12, wherein the respective frame of each of the first and second blades comprises two side members.

16. A bracelet for a timepiece, the bracelet comprising a folding buckle clasp as claimed in claim 1.

17. The bracelet as claimed in claim 16, wherein first and second strands of the bracelet each comprises, at a free end thereof, a respective housing defined in a respective inner face of the strand.

18. The bracelet as claimed in claim 17, wherein the housings are adapted to receive one of the first and second blades comprising a body of a component mounted in a pivotable manner with the blade arranged in a space defined in a frame of the blade when the clasp is in a closed position.

19. A timepiece having a bracelet as claimed in claim 16.

20. The bracelet as claimed in claim 17, wherein the housings defined in the first and second strands are adapted to receive the first and second blades and the flexible locking member in a closed position of the clasp so that external faces of the first and second blades, an internal face of the flexible locking member, and inner faces of the free ends of the first and second strands are contained substantially in a single plane.

21. The clasp as claimed in claim 1, wherein the elastic link elastically biases the first and second blades to remain folded in a locked manner in the closed position of the clasp.

22. The clasp as claimed in claim 1, wherein the elastic link of the flexible locking member includes an elastic or flexible blade or an elastic or flexible linking member which biases the clasp into a closed position.

23. The clasp as claimed in claim 1, wherein the elastic link of the flexible locking member includes an elastic or flexible blade or an elastic or flexible linking member which, during locking operation, is progressively stretched under tensile forces.

* * * * *